United States Patent [19]

Nagatani

[11] Patent Number: 4,905,985

[45] Date of Patent: Mar. 6, 1990

[54] CAM OPERATED GRIPPER FOR A PRINTING PRESS

[75] Inventor: Kazuo Nagatani, Seki, Japan

[73] Assignee: Sakura Seiki Co., Ltd., Japan

[21] Appl. No.: 283,589

[22] Filed: Dec. 13, 1988

[30] Foreign Application Priority Data

May 2, 1988 [JP] Japan ..... 63-109428

[51] Int. Cl.[4] ..... B41F 15/22

[52] U.S. Cl. ..... 271/277; 271/82; 101/124; 101/409

[58] Field of Search ..... 101/409, 282, 246, 118, 101/124; 271/277, 82

[56] References Cited

U.S. PATENT DOCUMENTS 3,221,652 12/1965 Mestre ..... 101/409 X
3,915,088 10/1975 Svantesson et al. ..... 101/124
3,982,922 9/1976 Krenzer et al. .
4,311,093 1/1982 Abendroth et al. ..... 101/409 X
4,357,870 11/1982 Rudolph et al. ..... 101/409 X
4,376,412 3/1983 Nagatani .
4,448,124 5/1984 Nagatani .
4,509,422 4/1985 Nagatani .
4,771,691 9/1988 Sakurai et al. .

*Primary Examiner*—Clifford D. Crowder
*Attorney, Agent, or Firm*—Ostrolenk, Faber, Gerb & Soffen

[57] ABSTRACT

A grip shaft is supported on a cylinder that makes an oscillating (reciprocating rotational) motion. The grip shaft is provided with a grip for holding a printing material. The grip is further provided with a cam follower. A cam is positioned along the path of motion of the cam follower, and the cam follower engages with an opening portion of the cam when the grip is right before a printing material feeder portion, and opens the grip. Further, when the grip reaches the printing material feeder portion, the cam follower moves to a closing portion of the cam, closing the grip to hold a printing material. After the grip has held a printing material, the cam follower disengages from the cam as the cylinder is rotated in the opposite direction. The opening portion and the closing portion composes a continuous cam surface.

8 Claims, 5 Drawing Sheets

CAM OPERATED GRIPPER FOR A PRINTING PRESS

FIELD OF THE INVENTION

The present invention relates to a grip switchgear for a cylinder press, specifically, to the improvement of the cam mechanism of the grip switchgear.

RELATED ART

FIG. 9 shows an example of a grip switchgear of the prior art wherein on cylinder 1 is rotated in a reciprocating manner by a cylinder driving mechanism (not shown in the illustration). A grip 3 is provided on the cylinder 1 by means of a grip shaft 2 such that the grip 3 is capable of a switching action, that is, opening and closing on the cylinder 1. A grip spring 4 serves to force the grip 3 to its closed position (in the closing direction). Further, a cam follower 6 is supported by the grip shaft 2 via an arm 5. The cam follower 6 is such that it becomes engaged with a semi-rectangular cam 7 simultaneous with the rotation of the cylinder 1. The cam 7 is rotatably supported by a fixed shaft 8. Ordinarily, the cam 7 is maintained in a position where it is in contact with a stopper 10 by the action of a cam spring 9.

FIG. 10 to FIG. 13 show the operation of the switchgear of the prior art constructed as described above. As shown in FIG. 10, when the cylinder 1 is rotated and the grip 3 reaches the position right in front of the printing material feeder portion 11, the cam follower 6 engages with the cam 7, and the grip 3 is opened, against the force of the grip spring 4.

When the grip 3 reaches the feeder portion 11 as the cylinder 1 is rotated further in the same direction, as shown in FIG. 11, the cam follower 6 falls off the cam 7 due to the action of the grip spring 4, and the grip 3 closes, holding a printing material P onto the cylinder 1. Afterward, the cylinder is immediately rotated in the opposite direction, and the printing material P is set on the cylinder 1 as the grip 3 moves from the feeder portion 11 toward the printing material discharging portion 13. At the start of this movement of the grip 3, since the cam follower 6 pulls at the upper corner of the cam 7 as the cam follower 6 is moved, the cam 7 is first rotated counterclockwise, against the force of the cam spring 9, as shown in the same illustration, then rotated clockwise due to the force of the cam spring 9, and collides with the stopper 10.

As shown in FIG. 12, during the forward movement of the grip 3, the printing process is performed, through a screen 15, on the printing material P on the cylinder 1 by means of a squeegee 14. Then, as shown in FIG. 13, when the grip 3 reaches the discharging portion 13, the cam follower 6 rolls along a grip releasing cam 16, releasing the grip 3 and discharging the (printed) printing material P.

However, in the grip switchgear described above, the following problems are encountered:

Firstly, since the cam follower 6 falls off the cam 7 when the grip 3 is closed, as shown in FIG. 11, the grip 3 strikes against the printing material P due to the force of the grip spring 4, thus making a "closing" noise.

Secondly, when the direction of motion of the grip 3 is reversed, in the feeder portion 11, the cam 7 collides strongly with the stopper 10 due to the action of the cam spring 9, thus making a loud noise (right after the state illustrated in FIG. 11).

Thirdly, if the force of the grip spring 4 is lessened in order to adjust the gripping capability of the grip 3, when the direction of motion of the grip 3 is reversed, the force of the grip spring 4 may become too weak compared to that of the cam spring 9, causing the grip 3 to open due to the engagement of the cam 7 and the cam follower 6, thus releasing the printing material P.

Fourth, in the state where the cam follower 6 and the cam 7 are not engaged, the grip 3 closes at a constant speed by the action of the grip spring 4. Therefore, a slight misplacement of the printing material occurs when there is a change in the speed of rotation of the cylinder 1.

SUMMARY OF THE INVENTION

The present invention is proposed as a solution to the problems stated above, and has the object of providing a grip switchgear for a cylinder press, in which the generation of noise during the closing of the grip is prevented, and in which the grip is capable of holding the printing material effectively in an accurate position during the printing process.

In order to realize the objects mentioned above, in the grip switchgear of the present invention, the grip is such that it is capable of opening and closing, and is provided on a cylinder that is rotated in a reciprocating manner by a cylinder driving mechanism. Simultaneous with the rotation of the cylinder, this grip is moved from the feeder portion toward the discharging portion while it is holding a printing material. A cam follower is connected to the grip, and a cam capable of engaging with the cam follower is provided near the cylinder, along the path of the cam follower. The cam is provided with a cam surface having a continuous opening portion and a closing portion. The opening portion engages with the cam follower right before the grip reaches the feeder portion and opens the grip. The closing portion engages with cam follower after the grip has reached the feeder portion, maintains this position, and closes the grip. The cam surface is disengaged from the cam follower during the movement of the grip from the feeder portion to the discharging portion.

In the present invention, the generation of noise during the closing of the grip is prevented. Likewise, the printing material is held effectively in an accurate position during the printing process.

The specific nature of the invention, as well as other objects, uses and advantages thereof, will clearly appear from the description and the from the accompanying drawings, in which:

BRIEF DESCRIPTION OF THE DRAWINGS

FIG. 1 is a front view of the grip switchgear; FIG. 2 to FIG. 7 are partial front views showing the various states of operation of the switchgear; FIG. 8 is a front view showing a general outline of the driving mechanisms of the cylinder and the cam.

DETAILED DESCRIPTION OF THE PREFERRED EMBODIMENT

Next, an embodiment of the present invention is described with reference to FIG. 1 to FIG. 8. The grip switchgear of the present invention has the same construction as that of the prior art (FIGS. 9–13) except for the difference in the construction of the cam used for closing and opening the grip, and the cam's driving mechanism.

Figure 1:
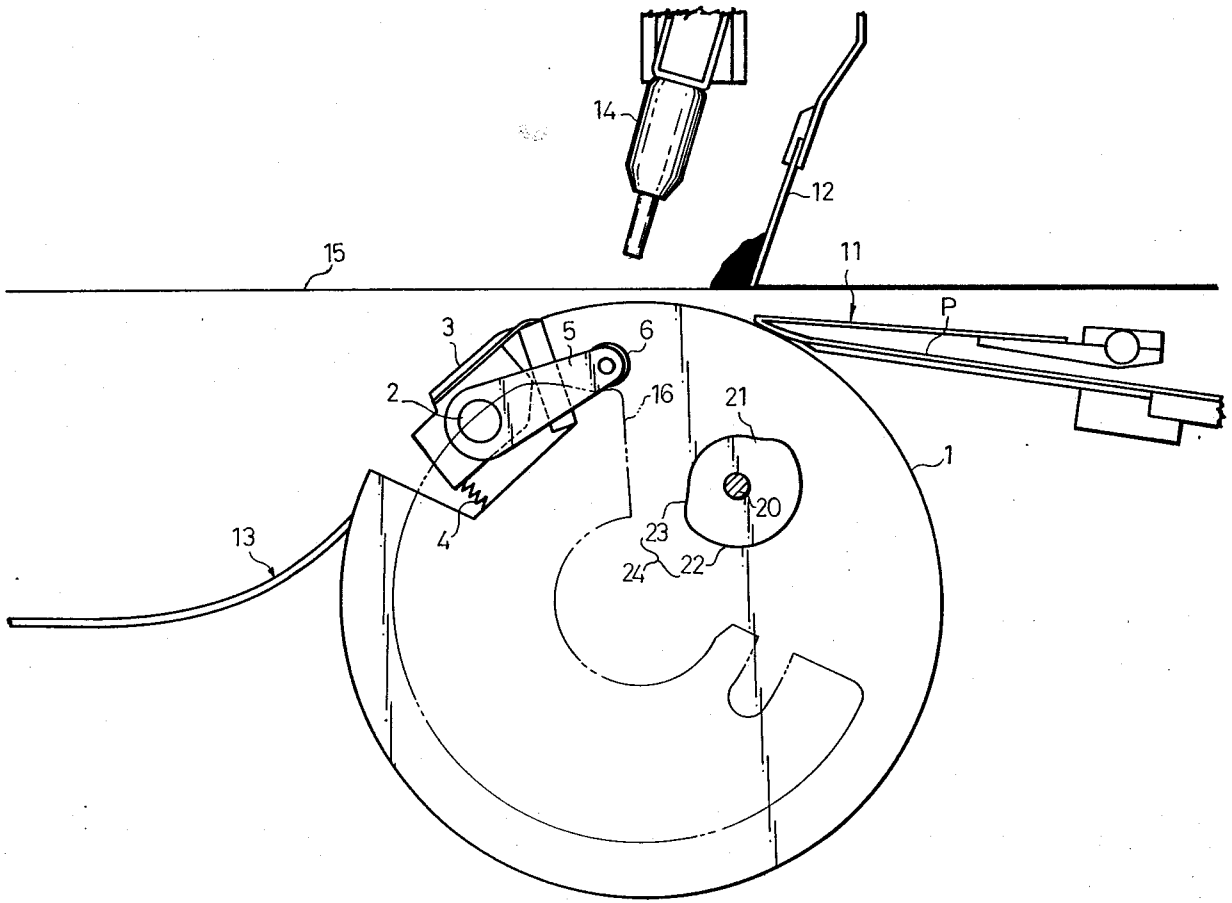
FIG. 1 to FIG. 8 show an embodiment of the present invention.

As shown in FIG. 1, a cam shaft 20 is rotatably supported near the feeder location or portion 11 on the printing machine frame, which is not shown in the illustration. A cam 21 is fixed to the cam shaft 20 such that it is positioned along the path of motion of the cam follower 6. A cam surface 24 is formed along the perimeter of the cam 21, comprising a semicircular opening portion 22, and a closing portion 23 of a smaller radius, the surfaces of both portions forming a single continuous surface.

Figure 4:
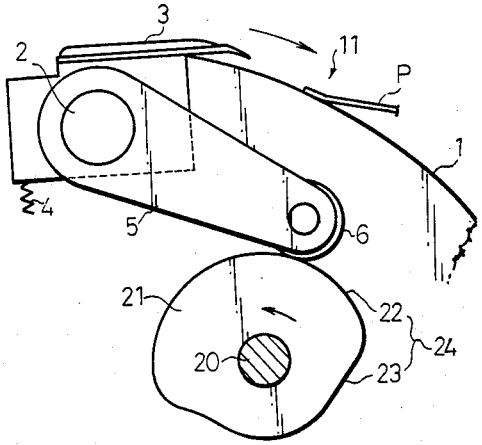
Figure 5:
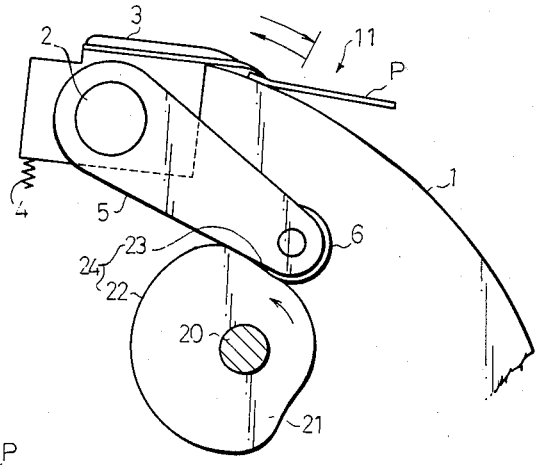
Figure 6:
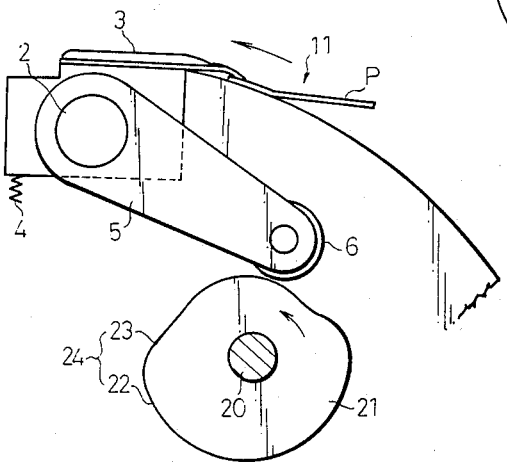
Figure 7:
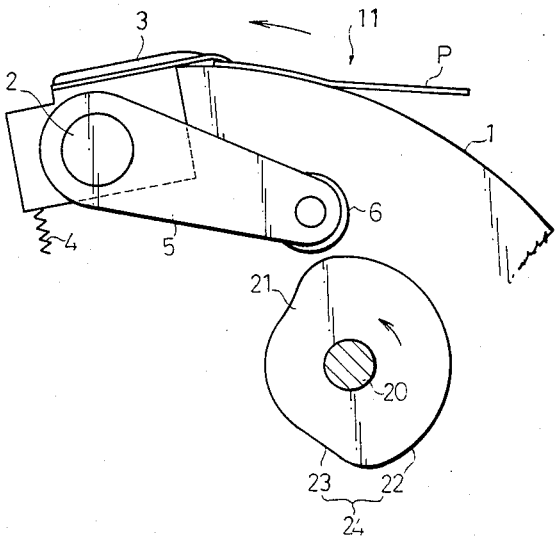

Then, as shown in FIG. 4, when the grip 3 is right before the feeder portion 11, the cam follower 6 engages with the opening portion 22 of the cam surface 24, and the grip 3 is opened. As shown in FIG. 5, when the grip 3 reaches the feeder portion 11, the cam follower 6 engages continuously with the closing portion 23 of the cam surface 24 and the grip 3 is closed. Also, as shown in FIG. 6 and FIG. 7, the cam follower 6 disengages from the cam surface 24 of the cam 21 as the grip 3 moves from the feeder portion 11 toward the discharging location or portion 13.

Figure 8:
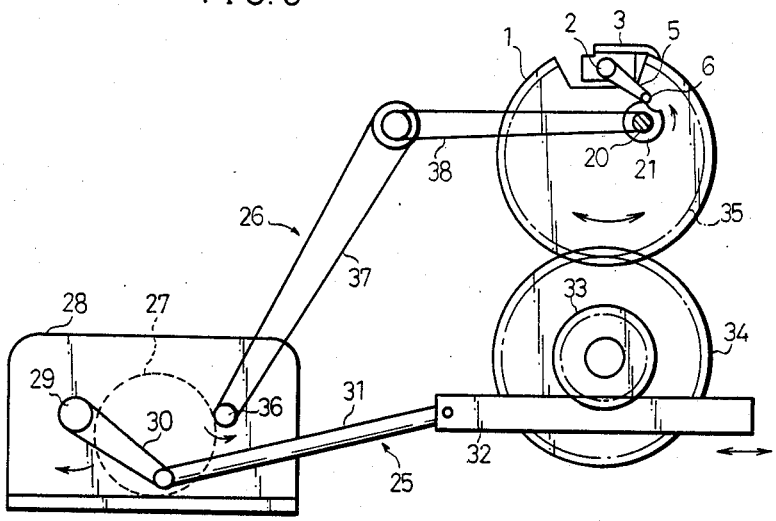
Figure 9:
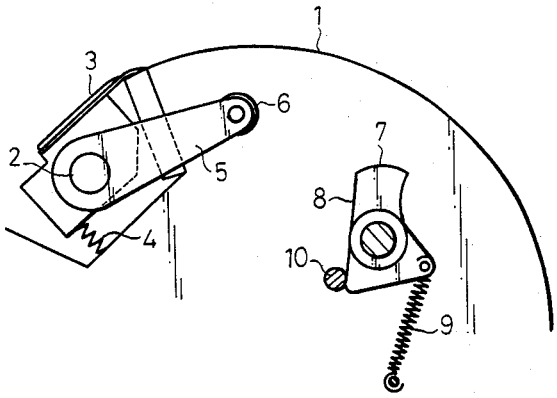
FIG. 9 (PRIOR ART)
FIG. 9 to FIG. 13 are partial front views showing the various states of operation of a grip switchgear of the prior art.
Figure 10:
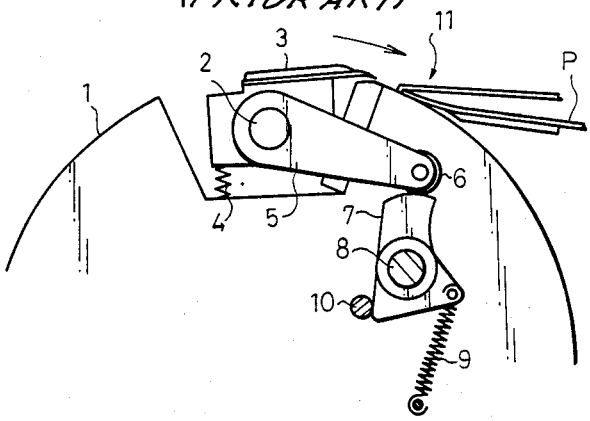
FIG. 10 (PRIOR ART)
Figure 12:
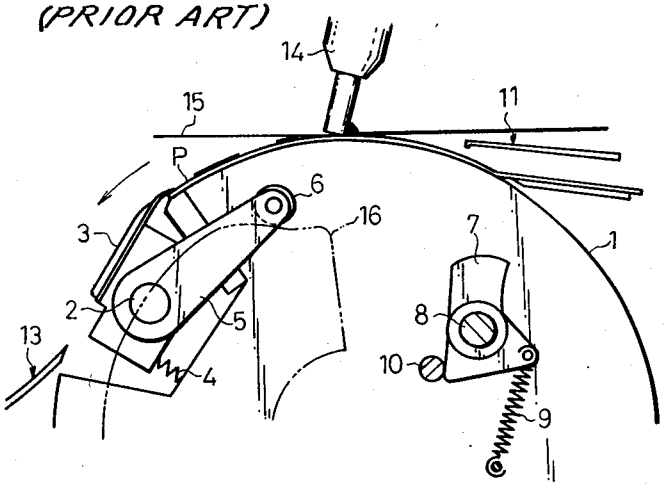
FIG. 12 (PRIOR ART)
Figure 11:
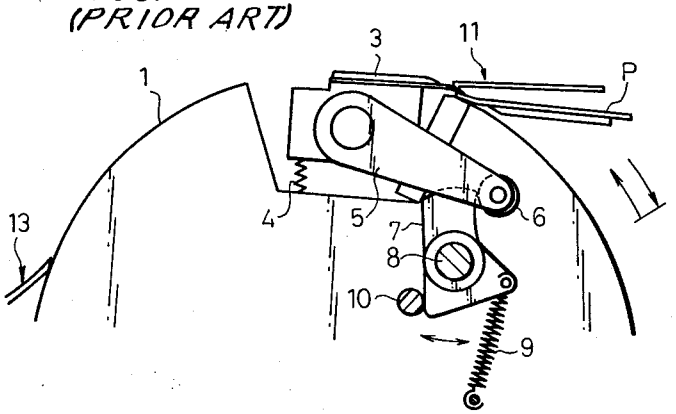
FIG. 11 (PRIOR ART)

FIG. 8 shows a general structure of a cylinder mechanism 25 and a cam driving mechanism 26. Both driving mechanisms 25, 26 are provided with the same motor 27 serving as the single source of the driving forces, and a speed reducer 28 for synchronizing the rotations of the cylinder 1 and the cam 21. A rack 32 is connected to one of the output shafts 29 of the speed reducer 28 via a crank arm 30 and a connecting rod 31. A reciprocating rotational motion is induced on the cylinder 1 by the reciprocating motion of the rack 32 by means of a small-radius gear 33, a large-radius gear 34 and a cyliner gear 35. Also, the other output shaft 36 of the speed reducer 28 is connected to the cam shaft 20 via two timing belts 37, 38. The cam 21 rotates in one direction, together with the cam shaft 20.

Next, the operation of the grip switchgear of the present embodiment is described.

Figure 2:
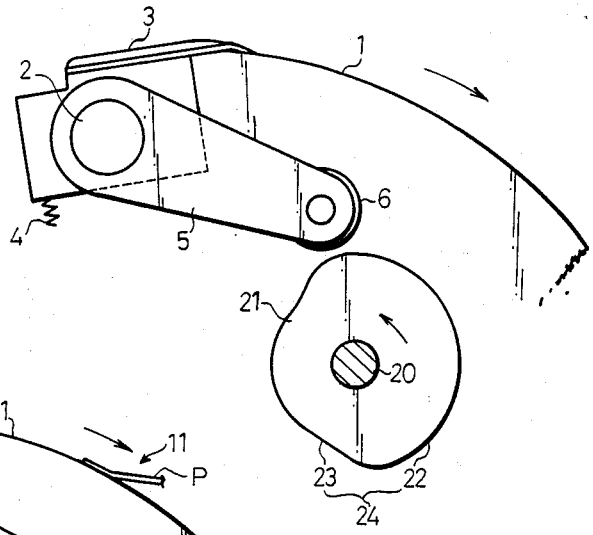
Figure 3:
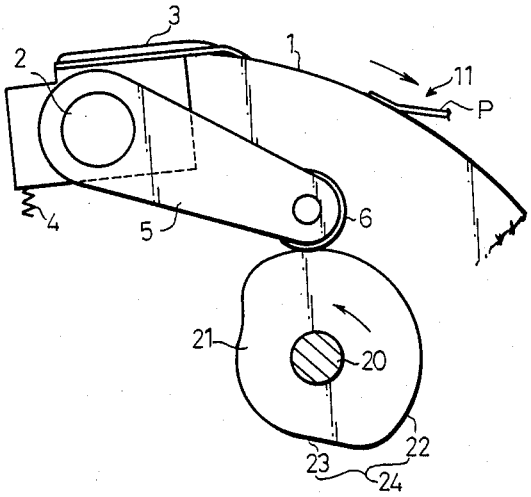

FIG. 1 and FIG. 2 show the grip 3 in its closed state moving from the discharging portion 13 toward the feeder portion 11. During this time, a doctor 12 is moving to paint ink on a screen 15. FIG. 3 shows the initial state of the engagement of the cam follower 6 and the cam 21 when the grip 3 is right before the feeder portion 11. In this state, when the cylinder 1 and the cam 21 are synchronously rotated in mutually opposing directions, as shown in FIG. 4, as the cam follower 6 moves along the opening portion 22 of the cam surface 24, the grip 3 is opened, against the force of the cam spring 4.

In this state, when the grip 3 reaches the feeder portion 11, as shown in FIG. 5, the cam follower 6 moves continuously along the opening portion 22 toward the closing portion 23 of the cam surface 24 due to the movement of the grip 3 and the rotation of the cam 21. The grip 3 is closed due to the action of the grip spring 4 as the cam follower 6 moves along the closing portion 23, and holds the printing material P onto the cylinder 1.

During this time, since the cam follower 6 moves smoothly and continuously along the cam surface 24, the grip closes quietly without making a closing sound. Also, no noise is generated while the cam follower moves along the opening portion 22 toward the closing portion 23. Further, since the cylinder 1 and the cam 21 are synchronously rotated by the same driving source 27, 28, even when there is a change in the speed of rotation of the cylinder 1, the grip 3 closes at the corresponding correct speed. Therefore, the problem of misplacement of the position of the printing material P by the grip 3 is prevented.

After the grip 3 has held the printing material P, the cylinder 1 rotates in the opposite direction, and the grip 3 moves from the feeder portion 11 toward the discharging portion 13. At the start of this movement, as clearly shown in FIG. 6, the cam follower 6 immediately disengages from the cam surface 24 of the cam 21, and afterward, this state of disengagement is maintained, as shown in FIG. 7. Therefore, while the grip 3 is moving from the feeder portion 11 toward the discharging portion 13, or, while the grip 3 is holding the printing material P, opening of the grip 3 due to the engagement of the cam follower 6 is completely prevented. Consequently, while the grip 3 is holding the printing material P effectively onto the cylinder 1, an accurate printing process can be performed on the printing material P using the squeegee 14 on the screen 15 (refer to FIG. 12).

Figure 13:
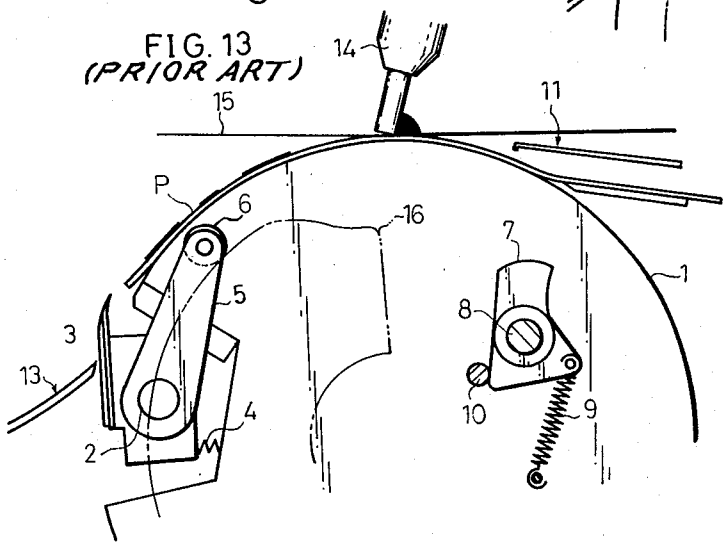
FIG. 13 (PRIOR ART)

When the grip 3 reaches the discharging portion 13, the cam follower 6 engages with a grip opening cam 16 as in the prior art, and the grip 3 opens, discharging the (printed) printing material P (refer to FIG. 13).

As many apparently widely different embodiments of this invention may be made without departing from the spirit and scope thereof, it is to be understood that the invention is not limited to the specific embodiments thereof except as defined in the appended claims.

What is claimed is:

1. A grip switchgear for an oscillating cylinder press adapted to be provided with a feeder portion and discharging portion near the vicinity of the cylinder, for respectively feeding a printing material to said cylinder and discharging said printing material from said cylinder; said grip switchgear further comprising:

a grip provided on said cylinder such that it is capable of closing and opening, and moves from said feeder portion toward said discharging portion with the rotation of said cylinder while holding said printing material, a cam follower connected to said grip, and a cam capable of engaging with said cam follower and positioned near said cylinder along the path of motion of said cam follower; said cam having a cam surface; said cam surface comprising an opening portion and a closing portion continuously connected; said opening portion engaging with said cam follower right before said grip reaches said feeder portion, thus opening said grip; said closing portion engaging with said cam follower and maintaining said engagement when said grip reaches said feeder portion, thus closing said grip; said cam surface disengaging from said cam follower when said grip commences moving away from said feeder portion toward said discharging portion and remaining disengaged until said grip reaches said discharging portion.

2. A grip switchgear for a cylinder press, as set forth in claim 1, further comprising a cam driving mechanism for rotating said cam in a single direction at uniform angular speed, said cam being rotatable via a shaft, and driving means for synchronously rotating said cylinder and said cam, connected to said cam driving mechanism and to a cylinder driving mechanism for inducing an oscillating motion on said cylinder.

3. A grip switchgear for a cylinder press, as set forth in claim 2, in which said driving means comprises a motor and a speed reducer connected to said motor.

4. A grip switchgear for a cylinder press, as set forth in claim 2, in which said cam driving mechanism further has an output shaft connected to said driving means, and a timing belt linked to said output shaft and to said shaft.

5. Sheet conveying apparatus including:

a cylinder and first drive means for oscillating said cylinder about a fixed first axis;

a sheet gripper carried by said cylinder back and forth between a feeder location whereat a sheet is delivered to said gripper and a discharging location wherein a sheet is released by said gripper;

control means for opening and closing said gripper at predetermined locations of said gripper;

said control means including a cam follower mounted to said cylinder and operatively connected to said gripper, a cam and second drive means for rotating said cam about a fixed second axis while said cylinder oscillates about said first axis;

said first axis being parallel to said second axis and laterally offset therefrom;

said cam having a cam surface that is engaged by said follower as said gripper moves toward said feeder location to first open said gripper to receive a sheet and then permit a biasing means to close said gripper on such sheet and remain closed while said gripper moves back toward said discharging location.

6. Sheet conveying apparatus as set forth in claim 5 in which the follower and the cam surface disengage when said gripper commences moving away from said feeder location and remain disengaged until said gripper reaches said discharging location.

7. Sheet conveying apparatus as set forth in claim 5 in which the cam rotates in a first direction which is opposite to direction of oscillatory movement for said cylinder while said gripper is being moved toward said feeder location.

8. Sheet conveying apparatus as set forth in claim 7 in which the follower and the cam surface disengage when said gripper commences moving away from said feeder location and remain disengaged until said gripper reaches said discharging location.

* * * * *